US005964659A

United States Patent [19]

Hertzler et al.

[11] Patent Number: 5,964,659

[45] Date of Patent: Oct. 12, 1999

[54] VENTILATED ENCLOSURE FOR GAS CYLINDERS AND MANIFOLDS

[75] Inventors: Benjamin Lee Hertzler, Allentown; Joseph Giagnacova, Harleysville, both of Pa.

[73] Assignee: Air Products and Chemicals, Inc., Allentown, Pa.

[21] Appl. No.: 08/932,258

[22] Filed: Sep. 17, 1997

[51] Int. Cl.[6] ..... F24F 7/007

[52] U.S. Cl. ..... 454/253; 364/528.17; 454/370

[58] Field of Search ..... 454/184, 253, 454/370; 364/528.1, 528.17; 312/209; 222/3

[56] References Cited

U.S. PATENT DOCUMENTS

| | | | |
|---|---|---|---|
| 4,625,627 | 12/1986 | Livanos et al. . | |
| 4,866,594 | 9/1989 | David et al. | 364/138 |
| 4,989,160 | 1/1991 | Garrett et al. | 364/509 |
| 5,095,736 | 3/1992 | Fesler et al. | 73/23.2 |
| 5,126,117 | 6/1992 | Schumacher et al. | 423/210 |
| 5,220,517 | 6/1993 | Sierk et al. | 364/550 |
| 5,417,236 | 5/1995 | Moore et al. | 137/15 |
| 5,497,316 | 3/1996 | Sierk et al. | 364/140 |
| 5,508,947 | 4/1996 | Sierk et al. | 364/571.01 |

OTHER PUBLICATIONS

GASGUARD® 250 Gas Cabinet, Air Products and Chemicals, Inc., 1994, 1995.

GASGUARD™ Valve Manifold Box, Air Products and Chemicals, Inc. 1992.

Tungsten Hexafluoride ($WF_6$) GASGUARD® Gas Cabinet, Air Products and Chemicals, Inc. 1995.

GASGUARD® 500 Gas Cabinet with VMB 500, Air Products and Chemicals, Inc. 1994, 1995.

*Primary Examiner*—Harold Joyce

*Attorney, Agent, or Firm*—Geoffrey L. Chase

[57] ABSTRACT

Method and apparatus for increasing the velocity of sweeping gas as it moves across a gas delivery system contained in a hazardous material delivery enclosure, e.g. a gas cabinet valve manifold box or gas isolation box. An exhaust port with selectively opened and closed apertures juxtaposed to non-soldered or non-welded fittings or connections in the gas delivery system is placed in or on said enclosure to create an accelerated and directed flow of sweeping gas across the non-soldered or non-welded fittings or connections.

14 Claims, 5 Drawing Sheets

VENTILATED ENCLOSURE FOR GAS CYLINDERS AND MANIFOLDS

CROSS-REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

The present invention pertains to enclosures for housing gas cylinders, distribution piping and manifolds used to store, distribute and dispense hazardous materials, such enclosures being generally referred to in the industry as gas cabinets, valve manifold boxes (VMB) and gas isolation boxes (GIB).

In the manufacture of semi-conductor devices, hazardous materials, such as gaseous silane are used. The gaseous materials are generally packaged in cylinders which are transported to the semi-conductor fabrication site (FAB) where the material is withdrawn and used to manufacture the semi-conductor devices. In order to protect the ambient environment, in the case of a leak in the distribution piping associated with withdrawing the gas from the cylinder, the cylinders are placed in a ventilated enclosure or gas cabinet. The gas cabinet contains all of the necessary piping and controls for selectively withdrawing the material from the cylinder and conducting it to a central pipeline for dispersion to the actual semi-conductor manufacturing operation or through a VMB or a GIB for redistribution in the FAB. Conventional gas cabinets have an inlet and outlet ducting so that ambient atmosphere can be continuously drawn through the cabinet and exhausted, thus sweeping into the exhaust system of the FAB any hazardous material leaking from the cylinder or the associated piping and controls.

Gas cabinets, valve manifold boxes and gas isolation boxes are widely available in industry. Numerous models are available from Air Products and Chemicals, Inc., Allentown, Pa.

U.S. Pat. No. 4,625,627 is illustrative of a ventilated gas cabinet for use in handling and dispensing hazardous gaseous materials.

U.S. Pat. Nos. 4,866,594; 4,989,160; 5,220,517; 5,497,316 and 5,508,947 further describe gas cabinets and methods for withdrawing the material contained in the cylinders and directing the material to a point of use.

One problem with known gas cabinets is that regulatory agencies are constantly changing the requirements for ambient atmosphere flow through the cabinets in order to have adequate ventilation of the cabinets. Most conventional gas cabinets are set up so that ambient atmosphere flows through the cabinet at the rate of about 50 to 100 feet per minute. Regulations have been made to require a minimum flow of 200 feet per minute inside of the cabinet especially in the vicinity of any non-soldered or non-welded pipe or fitting joint associated with the dispensing of a hazardous material. In order to achieve this type of flow in a conventional gas cabinet significantly increased capacity fans or blowers would be required for the users evacuation system. Merely increasing through velocity of the total volume of atmosphere would create significant problems for the user of the gas cabinet. Among these are higher capital costs, higher operating costs, such as energy requirements and maintenance, and additional space for equipment.

BRIEF SUMMARY OF THE INVENTION

In order to improve existing gas cabinets, valve manifold boxes and gas isolation boxes and to provide for such devices to be continuously swept with ambient atmosphere and to accelerate the flow of ambient atmosphere in those areas of the device where there are non-soldered or non-welded fittings it has been discovered that the exhaust for the device should be located in the back of the device which contains the piping, valves, manifolds etc. used to withdraw and dispense the hazardous material from the cylinder or redirect flow of the hazardous material. In a conventional gas cabinet, valve manifold box or gas isolation box it is conventional to refer to the valves manifolds, related equipment and connected piping as the gas panel. The exhaust port is adapted by means of apertures, which can be opened and closed selectively, to accelerate the ambient atmosphere flowing through the device in the vacinity of apertures that are open and, consequently over the portions of the gas panels where the nonsoldered and non-welded fittings are found. Alternatively a plate with sized and directed apertures can be used in the exhaust passage of the device or a perforated panel with or without a blanking strip(s) to direct airflow through the perforation(s) adjacent the non-welded fittings.

Therefore, in one aspect, the present invention is an enclosure adapted to contain gas storage and/or gas delivery systems for delivery of process gas under pressure to a point of use wherein the enclosure is adapted to be continuously swept with ambient atmosphere to remove process gas inadvertently released inside the enclosure, the enclosure having means to direct ambient atmosphere entering the enclosure over and around gas distribution or flow control equipment contained in the enclosure, the means adapted to accelerate the flow of ambient atmosphere, over and around non-soldered or non-welded connections present in distribution or flow control equipment in said enclosure.

In another aspect, the invention is a gas cabinet for use in the semiconductor industry to contain storage receptacles and delivery systems for gases used to fabricate electronic devices, the cabinet having means to continuously sweep interior portions of the cabinet with ambient atmosphere, the means adapted to direct ambient atmosphere entering the gas cabinet over and around gas distribution or flow control equipment contained in said cabinet, the means adapted to accelerate the flow of ambient atmosphere, over and around non-soldered or non-welded connections present in the distribution or flow control equipment.

In yet another aspect, the present invention is a method for manufacturing an enclosure used to contain gas storage and/or gas delivery systems disposed inside the enclosure, the enclosure having means to introduce and remove a sweeping gas used to remove leakage gas from the gas storage and/or gas delivery systems, comprising the steps of providing a sweeping gas exhaust port in a portion of the enclosure, the port positioned adjacent gas delivery equipment; and installing flow control means in the exhaust port to direct an accelerated flow of sweeping gas across selected portions of the gas delivery equipment prior to passing into the exhaust port.

Another aspect of the present invention is a method for increasing the flow of sweeping gas used to remove leakage gases from an enclosure used to contain gas storage and/or gas delivery systems disposed inside the enclosure, the method comprising the steps of providing a sweeping gas exhaust port in a portion of the enclosure the port positioned adjacent the gas delivery equipment and using flow control means installed in the exhaust port to direct an accelerated flow of sweeping gas across selected portions of the gas delivery equipment prior to passing into the exhaust port.

DETAILED DESCRIPTION OF THE INVENTION

The guiding objective for the present invention is to minimize the volumetric air flow required for gas cabinets, valve manifold boxes or gas isolation boxes used in the semi-conductor industry. Currently ventilation requirements for such equipment represents a significant cost to the end user, i.e. the manufacturer of the semi-conductor chips. As ventilation requirements become more stringent ventilation costs represent a significant portion of the operating costs for existing FAB's and initial and operating costs for new semi-conductor FABs.

In the past, most efforts to reduce ventilation requirements consisted of internal baffling inside the cabinet, raised floor perforated distribution plates, internal cabinet geometry (raised plenums, etc.), raised floors, and the like.

Figure 1:
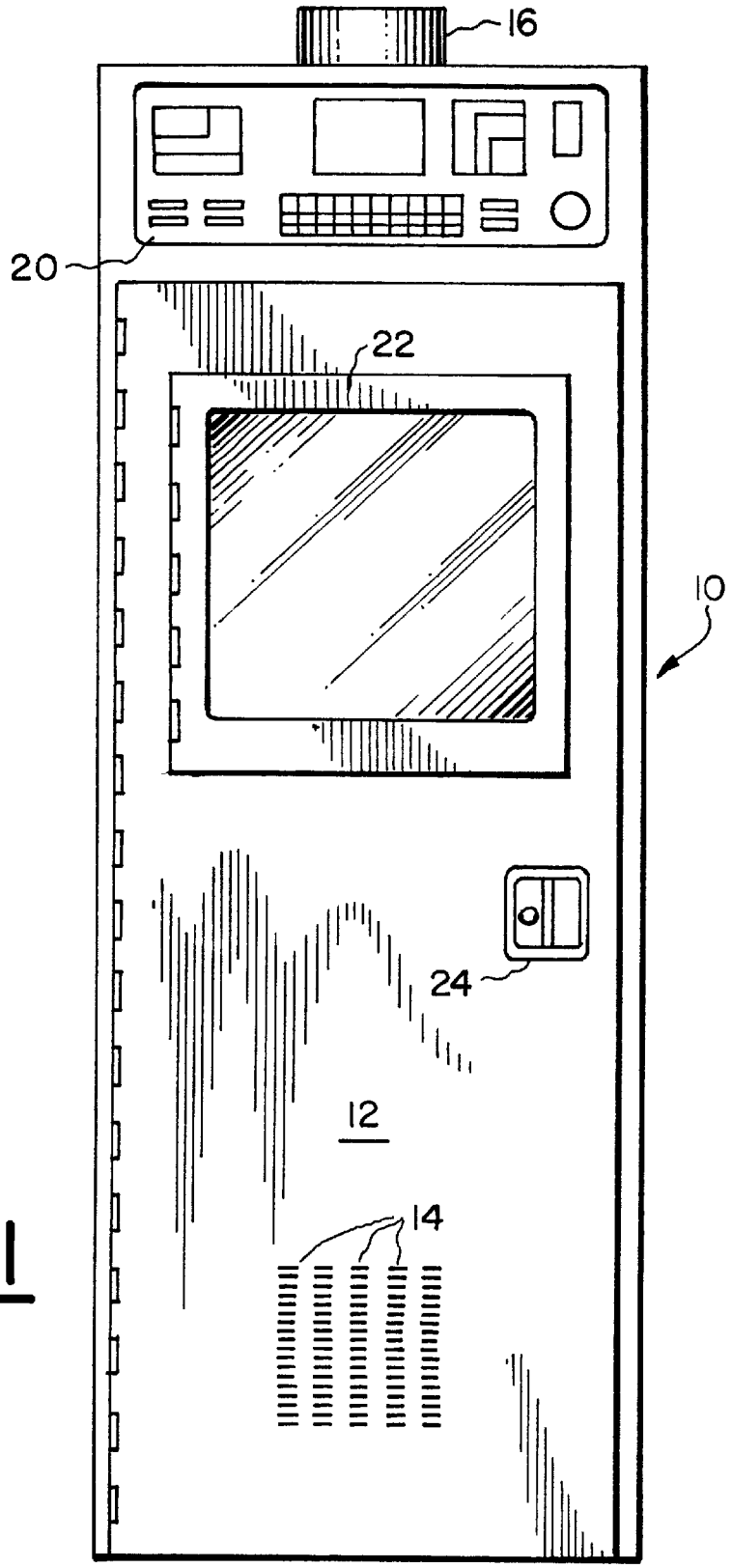
FIG. 1 is a front elevational view of a conventional gas cabinet suitable for the present invention.

Referring to FIG. 1, a gas cabinet 10 is basically a sheet metal enclosure in the form of an elongated vertically oriented box containing a door or access panel 12 which contains a louver or inlet 14 for ambient atmosphere to enter the cabinet and an exhaust duct 16. The gas cabinet includes a control panel 20 viewing port 22 and door latch and lock mechanism 24.

Figure 2:
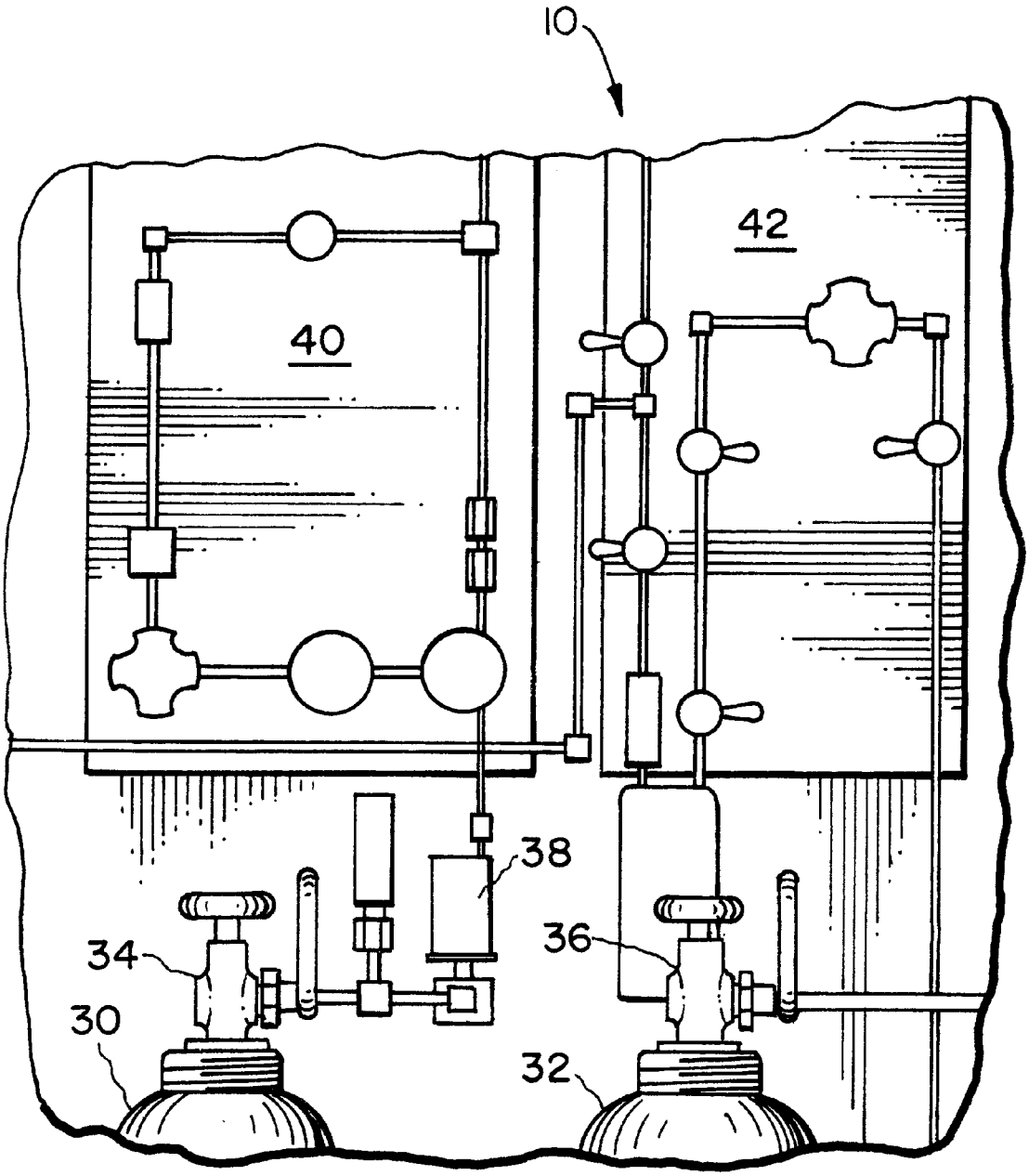
FIG. 2 is a view of a portion of the interior of the gas cabinet of FIG. 1.

As shown in FIG. 2, the interior of the cabinet 10 is adapted to contain gas cylinders 30 and 32 which can be used to hold hazardous chemicals and or hazardous chemicals in one and a purge gas in the other. The cylinders each have a cylinder control valve (34, 36 respectively) which is used to control flow out of the cylinders. The cylinder valves 34, 36 are in turn connected to flow control devices one of which 38 is shown in conjunction with the valve 34 of cylinder 30. The gas cabinets contain one or more gas panels 40, 42 which support or consist of the various manual and automatic control valves, associated piping, pneumatic actuating devices and the like, all of which are well known in the art. As used herein the terms gas panel refers to that portion of the gas cabinet, valve manifold box or gas isolation box where the piping, valves and associated fittings are placed. These items can be mounted on a plate which in the context of the invention can also be a wall of the gas cabinet. In a conventional gas cabinet, valve manifold box or gas isolation box most of the connections between the piping and the various components are made by a welding or soldering process to avoid leakage of the hazardous material at the fittings. However, it is not always possible to have all soldered or welded fittings such as at bonnets, at regulators, valves, etc. and sometimes threaded or other non-soldered or non-welded fittings must be used to make the various connections inside the gas cabinet, valve manifold box or gas isolation box. These techniques are also well known in the art, as is the placement of the various components.

Figure 3:
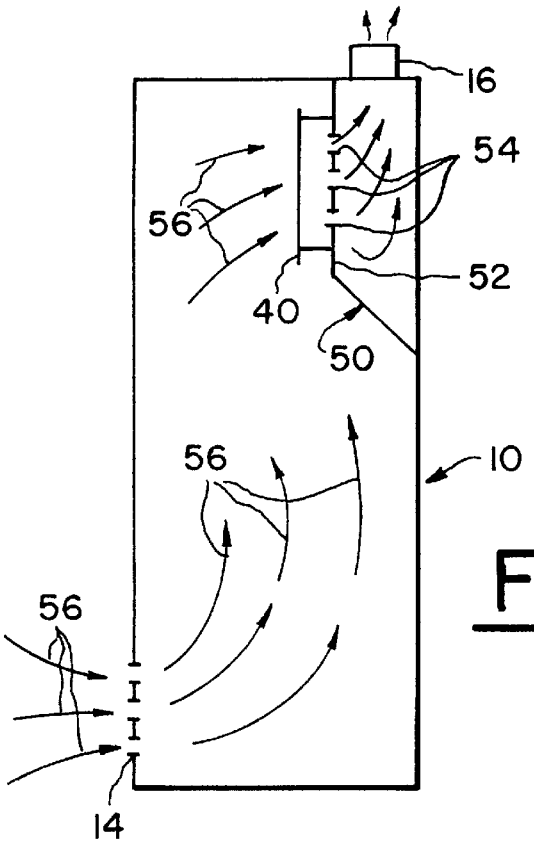
FIG. 3 is a side elevational schematic showing a location for the exhaust port according to the present invention.

Referring to FIG. 3, gas cabinet 10 has an arrangement whereby all of the necessary valves, fittings, connections and a major portion of the internal piping (e.g. gas panel 40) are fastened to a wall 52 of an exhaust device or port (duct) 50 placed inside of the cabinet 10. The exhaust port 50 includes a plurality of apertures or holes 54 in wall 52 which can be selectively opened or closed as will hereinafter be more fully explained. Gas exhaust port 50 communicates to the exhaust stack 16 which in turn is connected to the users ventilation system (not shown). Ambient atmosphere entering the gas cabinet 10 through the louver 14, as shown by arrows 56, flows upwardly through the cabinet 10 and then out through the exhaust port 50. However, before entering the exhaust port 50, the direction and velocity of the atmosphere is changed by the apertures or holes 54 contained in the exhaust port 50. By selectively locating certain of the apertures or holes 54 the velocity and direction of the ambient atmosphere can be controlled so that the atmosphere is accelerated as it flows over the gas panel and/or particular portions of the gas panel. This arrangement can preferentially increase velocity of the ambient atmosphere at critical parts of the panel, e.g. up to 200 feet per minute or more, in the vicinity of portions of the piping or fittings associated with the piping where there are non-welded or non-soldered connections or where there is a regulator or flow control device with a cap or bonnet that could potentially provide a source of gas leakage into the gas cabinet 10 or a valve manifold box or a gas isolation box. This results in ambient atmosphere velocities at higher rates than traditionally achieved with ventilation systems known in the art.

Figure 4:
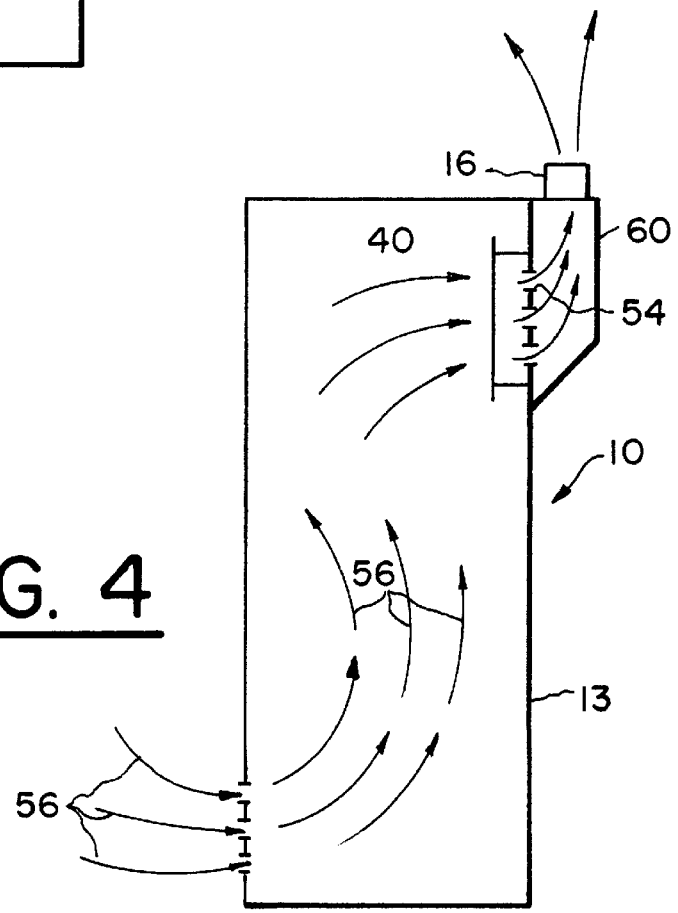
FIG. 4 is a side elevational schematic view of an alternate embodiment of the present invention.

FIG. 4 shows an alternate embodiment of the present invention where the exhaust port 60 is placed on the outside of the cabinet and the apertures or holes 54 can be placed in the portion of back wall 13 of the cabinet 10 that also forms a front wall of the exhaust port 60 or can be fabricated as a plate or cover used to close an exhaust opening in the wall 13 of cabinet 10. Here again, by selectively positioning the apertures or holes 54 the velocity and direction of the atmosphere, shown by arrows 56, can be controlled as it passes over the gas panel 40 in cabinet 10.

Figure 5:
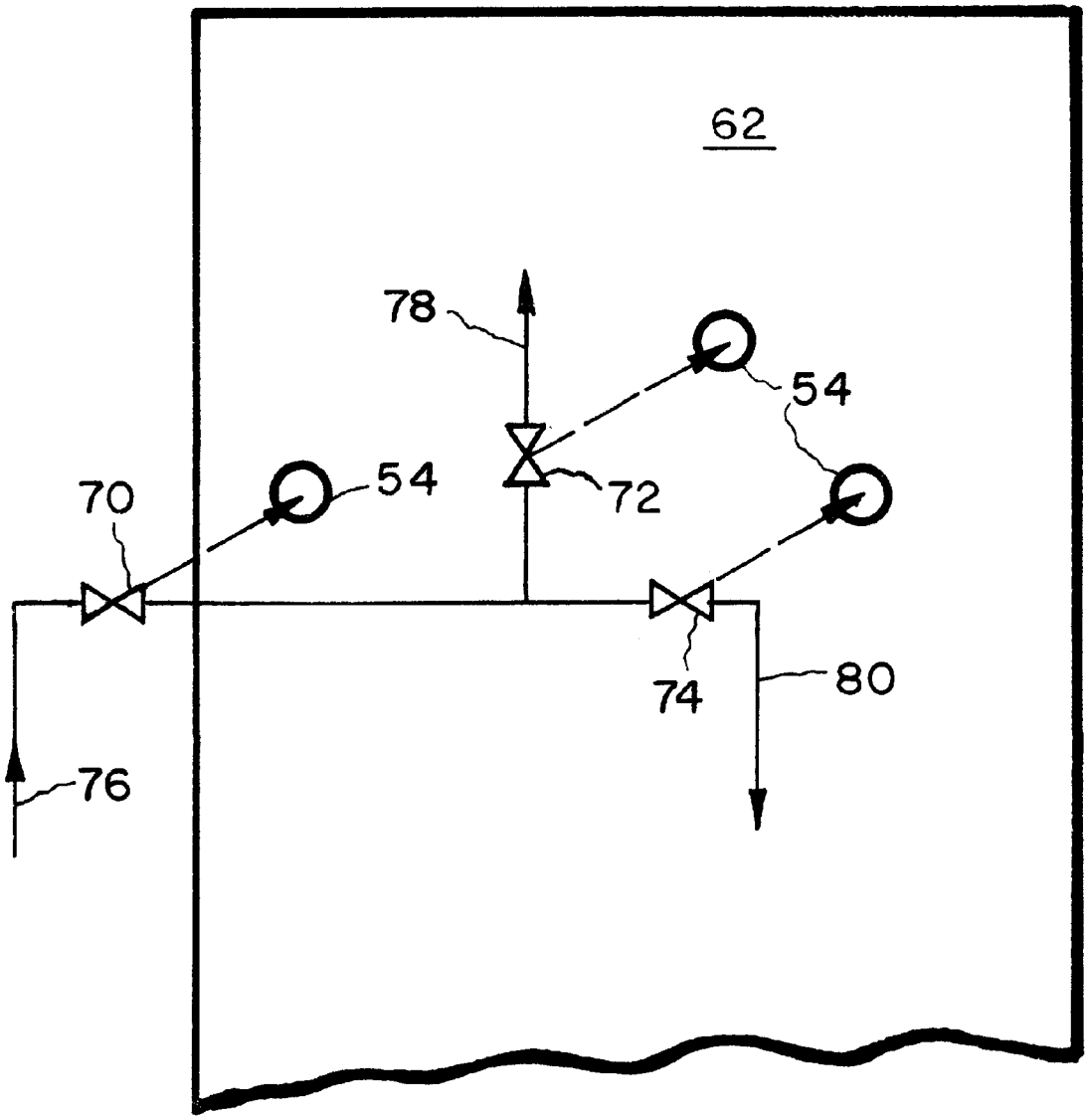
FIG. 5 is a fragmentary front elevational view of an interior wall of a gas cabinet showing one means for controlling flow through the exhaust port of the gas cabinet.

FIG. 5 illustrates one method of providing apertures in the exhaust device or the wall of the cabinet. As shown in FIG. 5, 62 represents the inward facing wall of the exhaust port 50 (FIG. 3) g the upper portion of the back wall 13 of gas cabinet 10 (FIG. 4) facing exhaust port 60 or a plate that can be used to close an opening in a gas cabinet, valve manifold box or gas isolation box that communicates with the exhaust port that in turn communicates with the exhaust system for the gas cabinet, etc. Portion or plate 62 of the gas cabinet, valve manifold box or gas isolation box contains a plurality of holes 54 which are disposed adjacent to or juxtaposed to fittings, e.g. valves 70, 72, 74, which are disposed in the piping via non-welded or non-soldered connections, e.g. mechanical fittings such as compression fittings, face seal fittings or threaded couplings which are well known in the art. Thus, as the ambient atmosphere is moved through the gas cabinet 10 it is accelerated by virtue of the apertures 54 immediately adjacent the non-welded or non-soldered fittings joining valves 70, 72, 74 to the piping to control flow of process gas from inlet 76 to outlets 78, 80, in order to provide the volumetric flow required by local state or federal regulations. The illustration in FIG. 5 should be interpreted to show that the structural member 62 can be the back of the gas cabinet or other isolation device or it can be the internal face of exhaust plenums of such device.

Figure 6:
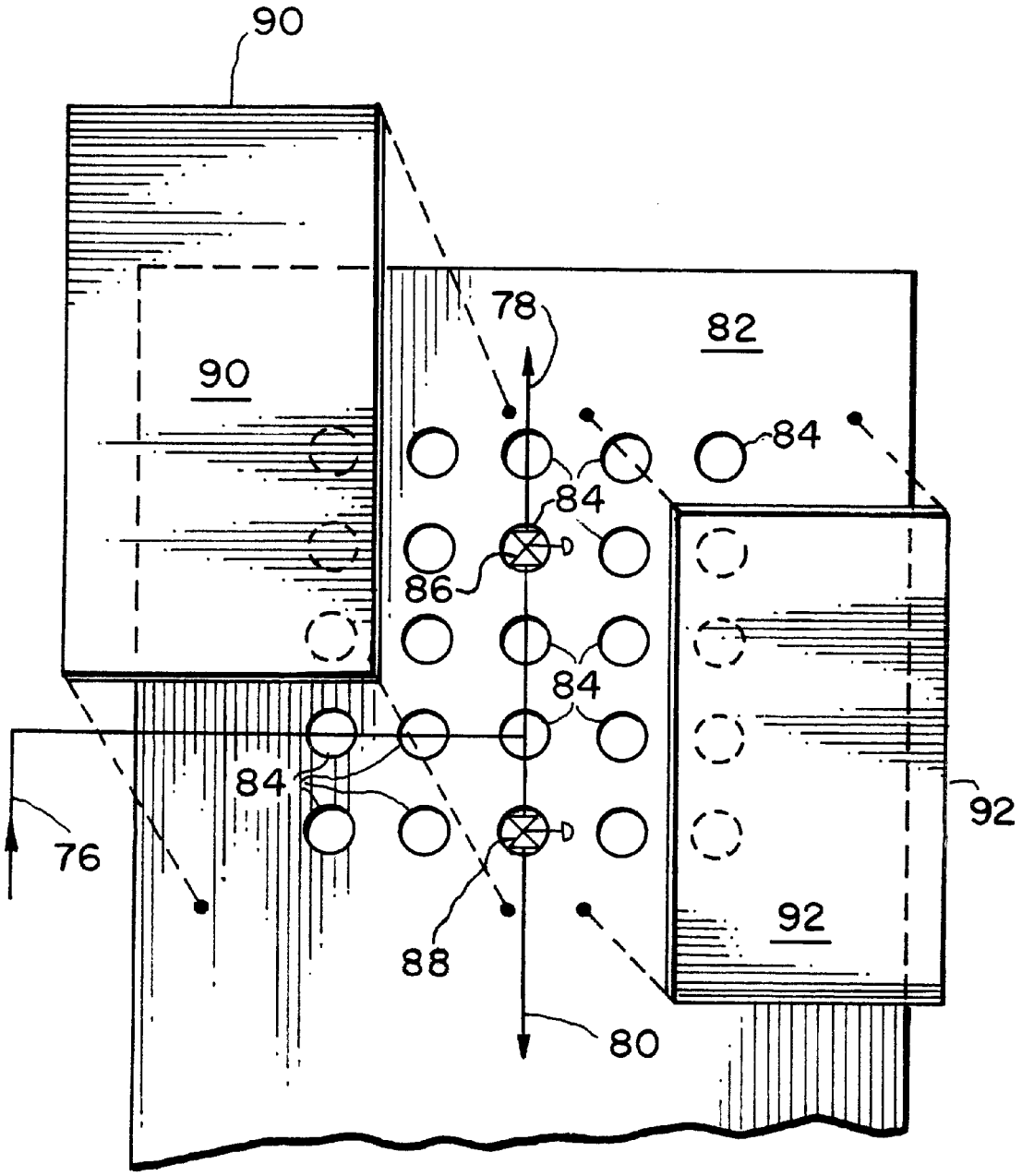
FIG. 6 is a fragmentary front elevational view of an interior wall of a gas cabinet showing another means for controlling flow through the exhaust port of the gas cabinet.

The back plate or wall 82 of the exhaust device that is juxtaposed to the non-soldered or non-welding fittings disposed inside the gas cabinet, valve manifold box or gas isolation box can also be provided with a series of pre-drilled holes 84 aligned in a regular pattern, e.g. a rectangular pattern as shown in FIG. 6. When the user decides the precise positioning of the equipment e.g. valves 86, 88 inside of the device the holes that are not juxtaposed to the non-soldered or non-welded connections can be closed by one or more blanking plates 90, 92 or other similar device such as illustrated in FIG. 6. The arrangement of the pre-drilled holes provides maximum flexibility for the manufacturer. Using pre-drilled holes in a wall of a gas cabinet, valve manifold box or gas isolation box facilitates manufacture of devices of various dimensions as stock items.

As shown and described above the gas cabinet, valve manifold box or gas isolation box according to the invention, used to house distribution piping, valves, manifolds, and/or cylinder(s) for storing and or dispensing hazardous gases etc., is ventilated through the back of gas cabinet directly behind the gas panel. The ventilation ports are designed and manufactured so that the exhaust air flows directly across any mechanical fittings which may be present in the device (on the gas panel).

The main feature of the present invention is that exhaust air can be directed across any mechanical fittings which are present on the gas panel. Thus, certain minimum flow rates of ambient atmosphere can be maintained across all non-welded or non-soldered connections inside the gas cabinet. It is not possible to achieve this in conventional gas cabinets without extensive baffling and high ventilation rates.

According to the present invention exhaust ports of the cabinet are placed directly behind the fittings which are non-welded or non-soldered thus allowing air flow to be directed locally across the fittings, thereby minimizing the air flow requirements in the cabinet and reducing overall operating cost for the user.

Having thus described our invention, what is desired to be secured by Letters Patent of the United States includes all modification within the spirit and scope of the appended claims.

What is claimed:

1. In an enclosure adapted to contain one of gas storage and/or gas delivery systems for delivery of process gas under pressure to a point of use wherein the enclosure is adapted to be continuously swept with ambient atmosphere to remove process gas inadvertently released inside said enclosure, the improvement comprising:

means to direct ambient atmosphere entering said enclosure over and around gas distribution or flow control equipment contained in said enclosure, said means adapted to accelerate the flow of ambient atmosphere, over and around non-soldered or non-welded connections present in distribution or flow control equipment in said enclosure.

2. An enclosure according to claim 1 wherein said means to direct ambient atmosphere includes an exhaust port on a back portion of said enclosure directly behind said distribution or flow control equipment, said exhaust port having a wall containing apertures that can be selectively opened or closed to direct ambient atmosphere flow over portions of said flow control equipment containing non-soldered or non-welded connections.

3. An enclosure according to claim 1 wherein said means to direct ambient atmosphere includes an exhaust port on a back portion of said enclosure directly behind said distribution or flow control equipment said exhaust port including holes juxtaposed to non-soldered or non-welded connections in said gas distribution or flow control equipment to accelerate flow of ambient atmosphere over and around said non-soldered or non-welded connections.

4. In a gas cabinet for use to contain storage receptacles and delivery systems for dangerous gases said cabinet having means to continuously sweep interior portions of the cabinet with ambient atmosphere, the improvement comprising:

means to direct ambient atmosphere entering said gas cabinet over and around gas distribution or flow control equipment contained in said cabinet, said means adapted to accelerate the flow of ambient atmosphere, over and around non-soldered or non-welded connections present in said distribution or flow control equipment.

5. A gas cabinet according to claim 4 wherein said means to direct ambient atmosphere includes an exhaust port on a back portion of said gas cabinet directly behind said gas panel, said exhaust port having apertures that can be selectively opened or closed to direct accelerated ambient atmosphere flow over said non-soldered or non-welded connection in said distribution or flow control equipment.

6. A gas cabinet according to claim 4 wherein said means to direct ambient atmosphere includes an exhaust port on an upper back portion of said gas cabinet directly behind said distribution or flow control equipment, said exhaust port including holes juxtaposed to non-soldered or non-welded connections in said gas distribution or flow control equipment to accelerate flow of ambient atmosphere over non-soldered or non-welded connections.

7. A method for manufacturing an enclosure used to contain one of gas storage and/or gas delivery systems disposed inside said enclosure said enclosure having means to introduce a sweeping gas used to remove leakage gas from said gas storage and/or gas delivery systems, comprising the steps of:

providing a sweeping gas exhaust port in a portion of said enclosure, said port positioned adjacent said gas delivery equipment; and installing flow control means in said exhaust port to direct an accelerated flow of sweeping gas across selected portions of said gas delivery equipment prior to passing into said exhaust port.

8. A method according to claim 7 wherein said sweeping gas passes over said selected portions of said gas delivery equipment at a rate of up to 200 feet per minute or higher prior to entering said exhaust port.

9. A method according to claim 7 including installing a panel with apertures that can be selectively opened and closed as said flow control means in said exhaust port to accelerate flow of sweeping gas across selected portions of said gas delivery equipment.

10. A method according to claim 7 including installing a panel with holes positioned adjacent non-soldered or non-welded fittings or connections in said gas delivery equipment to direct an accelerated flow of sweeping gas across said non-soldered or non-welded fittings or connections.

11. A method for increasing the flow of sweeping gas used to remove leakage gases from an enclosure used to contain one of gas storage and/or gas delivery systems disposed inside said enclosure comprising the steps of:

providing a sweeping gas exhaust port in a portion of said enclosure, said port positioned adjacent said gas delivery equipment; and using flow control means installed in said exhaust port to direct an accelerated flow of sweeping gas across selected portions of said gas delivery equipment prior to passing into said exhaust port.

12. A method according to claim 7 wherein said sweeping gas passes over said selected portions of said gas delivery equipment at a rate of up to 200 feet per minute prior to entering said exhaust port.

13. A method according to claim 7 including flowing said sweeping gas across a panel with apertures that can be selectively opened and closed as said flow control means in said exhaust port to accelerate flow of sweeping gas across selected portions of said gas delivery equipment.

14. A method according to claim 7 including flowing said sweeping gas across a panel with holes positioned adjacent non-soldered or non-welded fittings or connections in said gas delivery equipment to direct an accelerated flow of sweeping gas across said non-soldered or non-welded fittings or connections.

* * * * *